United States Patent [19]

Fushida et al.

[11] 4,438,187

[45] Mar. 20, 1984

[54] PHOTOSENSITIVE COMPOSITION FOR ELECTROPHOTOGRAPHY WITH CHLORONAPHTHOQUINONES

[75] Inventors: Akira Fushida, Suita; Yoshiaki Kato, Hirakata, both of Japan

[73] Assignee: Mita Industrial Co. Ltd., Osaka, Japan

[21] Appl. No.: 366,331

[22] Filed: Apr. 7, 1982

[30] Foreign Application Priority Data

Apr. 6, 1981 [JP] Japan ..... 56-50579

[51] Int. Cl.[3] ..... G03G 5/06; G03G 5/07; G03G 5/09

[52] U.S. Cl. ..... 430/81; 430/83; 430/900

[58] Field of Search ..... 430/81, 83, 900

[56] References Cited

U.S. PATENT DOCUMENTS

| | | | |
|---|---|---|---|
| 3,037,861 | 6/1962 | Hoegl et al. | 430/80 |
| 3,904,407 | 9/1975 | Regensburger et al. | 430/58 |
| 4,264,695 | 4/1981 | Kozima et al. | 430/81 X |
| 4,302,521 | 11/1981 | Takei et al. | 430/81 X |

*Primary Examiner*—Roland E. Martin, Jr.
*Attorney, Agent, or Firm*—Sherman & Shalloway

[57] ABSTRACT

Disclosed is a photosensitive composition for electrophotography, which comprises 100 parts by weight of polyvinyl carbazole, 5 to 50 parts by weight of a perylene pigment and 5 to 50 parts by weight of a halonaphthoquinone.

7 Claims, No Drawings

PHOTOSENSITIVE COMPOSITION FOR ELECTROPHOTOGRAPHY WITH CHLORONAPHTHOQUINONES

BACKGROUND OF THE INVENTION

1. Field of the Invention

The present invention relates to a photosensitive composition for electrophotography. More specifically, the present invention relates to a photosensitive composition for electrophotography, which comprises 100 parts by weight of polyvinyl carbazole, 5 to 50 parts by weight of a perylene pigment and 5 to 50 parts by weight of a halonaphthoquinone.

2. Description of the Prior Art

Polyvinyl carbazole has been widely used as an organic polymeric photoconductor for the production of photosensitive layers for electrophotography. Polyvinyl carbazole is an electron donor, and it is known that polyvinyl carbazole forms a charge-transfer complex together with an electron acceptor to exert a sensitizing effect.

It also is known that in a photosensitive layer formed by dispersing an inorganic or organic photoconductive pigment in the above-mentioned charge-transfer complex, the pigment acts as a charge-generating agent and the complex acts as a charge-transferring agent and the photosensitive layer has excellent electrophotographic characteristics.

SUMMARY OF THE INVENTION

The present invention provides an improvement in the above-mentioned type photosensitive composition for electrophotography. The present invention is based on the novel finding that when a halonaphthoquinone is selected as the electron acceptor and is incorporated in a system comprising polyvinyl carbazole and a perylene pigment, prominent increase of the sensitivity can be attained.

More specifically, in accordance with the present invention, there is provided a photosensitive composition for electrophotography, which comprises 100 parts by weight of polyvinyl carbazole, 5 to 50 parts by weight of a perylene pigment and 5 to 50 parts by weight of a halonaphthoquinone.

DETAILED DESCRIPTION OF THE PREFERRED EMBODIMENTS

The halonaphthoquinone that is used in the present invention may be represented by the following general formula:

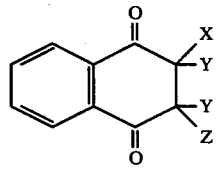

wherein X stands for a halogen atom, Z stands for a halogen or hydrogen atom, and Y stands for a hydrogen atom, with the proviso that two hydrogen atoms as Y may be removed to form a carbon-to-carbon double bond.

It is ordinarily preferred that in the above general formula, the halogen atom be a chlorine or bromine atom. As preferred examples of the halonaphthoquinone, there can be mentioned 2-chloro-1,4-naphthoquinone, 2,3-dichloro-1,4-naphthoquinone, 2,3-dibromo-1,4-naphthoquinone and 2,3-dichloro-2,3-dihydro-1,4-naphthoquinone.

The present invention is based on the finding that the above-mentioned halonaphthoquinone has a highly prominent sensitizing effect to a polyvinyl carbazole-perylene type pigment system as compared with the effect attained by an analogous compound such as naphthoquinone or anthraquinone. The sensitivity of a photosensitive layer for electrophotography is expressed by the exposure quantity (lux·sec) for half decay of the potential. When naphthoquinone or anthraquinone is incorporated in the above-mentioned system, the sensitivity is ordinarily from 32 to 46 lux·sec. In contrast, if the above-mentioned halonaphthoquinone is incorporated into the above-mentioned system, the sensitivity is from 18 to 23 lux·sec. Incidentally, the smaller is the value of the exposure quantity for half decay of the potential, the higher is the sensitivity. Namely, the sensitivity is highly improved according to the present invention.

It is considered that if the halonaphthoquinone is incorporated into the above-mentioned system, the halonaphthoquinone forms a charge-transfer complex with polyvinyl carbazole.

It is important that the halonaphthoquinone should be used in an amount of 5 to 50 parts by weight, especially 10 to 30 parts by weight, per 100 parts by weight of polyvinyl carbazole. If the amount of the halonaphthoquinone is too small and below the above range, no satisfactory sensitivity can be obtained, and if the amount of the halonaphthoquinone is too large and exceeds the above range, the initial saturation charge voltage is reduced, and the halonaphthoquinone is precipitated as crystals in the photosensitive layer, resulting in reduction of the sensitivity or film characteristics.

In the present invention, it also is important that a perylene pigment should be used as the photoconductive or charge-generating pigment to be dispersed in the polyvinyl carbazole-halonaphthoquinone complex. The reason is that the halonaphthoquinone has a peculiarly excellent sensitizing effect to the combination of polyvinyl carbazole and a perylene pigment as pointed out hereinbefore.

As the perylene pigment, there may be used a known pigment represented by the following general formula:

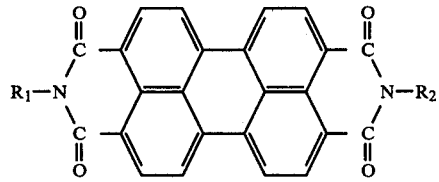

(2)

wherein $R_1$ and $R_2$ stand for a hydrogen atom or a substituted or unsubstituted alkyl or aryl group.

As preferred examples of the substituent, there can be mentioned a hydroxyl group, an alkoxy group, an amino group, a nitro group and a halogen atom.

As preferred examples of the perylene pigment, there can be mentioned N,N'-dimethylperylene-3,4,9,10-tetracarboxylic acid diimide, N,N'-di(3,5-dimethylphenyl)perylene-3,4,9,10-tetracarboxylic acid diimide, N,N'-di(4-ethoxyphenyl)perylene-3,4,9,10-tetracarboxylic acid diimide and N,N'-di(4-toluyl)perylene-3,4,9,10-tetracarboxylic acid diimide, though perylene pigments that can be used in the present invention are not limited to those exemplified above.

It is important that the perylene pigment should be used in an amount of 5 to 50 parts by weight, especially 10 to 30 parts by weight, per 100 parts by weight of polyvinyl carbazole. If the amount of the perylene pigment is too small and below the above range, no satisfactory sensitivity can be obtained, and if the amount of the perylene pigment is too large and exceeds the above range, both the initial saturation charge voltage and the sensitivity tend to decrease.

In accordance with one preferred embodiment of the present invention, other photoconductive pigment is used in combination with the above-mentioned perylene pigment. As such photoconductive pigment, there can be mentioned phthalocyanine pigments and disazo pigments. If such pigment having a sensitivity to red color wavelengths is used in an amount of 2 to 10 parts by weight per 100 parts by weight of the perylene pigment, the sensitivity to red color wavelengths can be increased and the photosensitive wavelength region of the photosensitive layer can be rendered panchromatic.

In order to increase the mechanical strength of the photosensitive layer and improve the adhesion to a conductive substrate, there may be used a binder having no photoconductivity, for example, a polyester resin, an epoxy resin, a polycarbonate resin, a polyurethane resin, a xylene resin, an acrylic resin or a styrene-butadiene copolymer. This binder may be used in an amount of 0.1 to 50 parts by weight, especially 10 to 30 parts by weight, per 100 parts by weight of polyvinyl carbazole.

In order to improve the surface smoothness of the photosensitive layer, there may be used a levelling agent such as polydimethylsiloxane in an amount of 0.005 to 5 parts by weight per 100 parts by weight of polyvinyl carbazole.

The photosensitive composition of the present invention is coated as a layer having a certain thickness on a photoconductive substrate and is used in the form of a photosensitive material for electrophotography.

As the conductive substrate, there may be used a foil, plate, sheet or drum of a metal such as aluminum, copper, tin or tinplate. Moreover, there may be used a substrate prepared by depositing a metal such as mentioned above on a film base such as a biaxially stretched polyester film or a glass sheet by vacuum evaporation deposition sputtering or non-electrolytic plating. Moreover, there may be used Nesa glass as the conductive substrate.

The coating composition is prepared by dispersing the perylene pigment, optionally with a phthalocyanine or disazo pigment, in a good solvent for polyvinyl carbazole such as tetrahydrofuran, dichloroethane or toluene-cyclohexanone by ultrasonic vibration or high shearing agitation and dissolving polyvinyl carbazole and the halonaphthoquinone into the dispersion. From the viewpoint of the adaptability to the coating operation, it is preferred that the solid concentration of the so-formed coating composition be 5 to 12% by weight.

From the viewpoint of the electrophotographic characteristics, it is preferred that the thickness of the layer of the photosensitive composition after drying be 3 to 30μ, especially 8 to 15μ.

As will be apparent from Examples given hereinafter, the photosensitive composition of the present invention has an excellent sensitivity whether it may be subjected to positive charging or negative charging. However, if the photosensitive layer is subjected to positive charging and then subjected to imagewise light exposure, a further enhanced sensitivity can be obtained.

The present invention will now be described in detail with reference to the following Examples that by no means limit the scope of the present invention.

EXAMPLE 1

Effects attained by adding 2,3-dichloro-1,4-naphthoquinone to compositions comprising polyvinyl carbazole (hereinafter referred to as PVK) and a perylene pigment according to the present invention were examined. As the perylene pigment, there were used N,N'-di(3,5-dimethylphenyl)perylene-3,4,9,10-tetracarboxylic acid diimide (Pigment Red 149) (sample A), N,N'-di(4-ethoxyphenyl)perylene-3,4,9,10-tetracarboxylic acid diimide (C.I. 71145) (sample B) and N,N'-dimethylperylene-3,4,9,10-tetracarboxylic acid diimide (C.I. 71130) (sample C). Photosensitive plates were prepared according to the following procedures.

At first, 0.2 g of the perylene pigment was dispersed in 6 g of tetrahydrofuran as the solvent and 0.5 g of cyclohexanone by an ultrasonic dispersing machine. Then, 10 g of PVK (tetrahydrofuran solution having a solid concentration of 10%), 2 g of a polyester resin (Adhesive 49000 supplied by Du Pont Co.) (tetrahydrofuran solution having a solid concentration of 10%) as a reinforcing resin and 5 mg of a silicone oil as a levelling agent were added to the dispersion, and 0.2 g of 2,3-dichloro-1,4-naphthoquinone was further added to the dispersion to form a coating composition (present invention). For comparison, a coating composition (comparison) was prepared in the same manner as described above except that 2,3-dichloro-1,4-naphthoquinone was not added.

The so-formed coating composition was coated on a base obtained by forming an alumite layer having a thickness of about 5μ on a hard aluminum sheet having a thickness of 80μ, by using a coating bar No. 40, and was then dried at 100° C. for 20 minutes. The obtained photosensitive material was allowed to stand in the dark place overnight and was then charged at +6 KV or −6 KV by an electrostatic copying tester (Model SP-428 supplied by Sawaguchi Denki K.K.) according to Static Measurement Mode No. 1 (charge speed of 5 m/min). The potential Vo after the dark decay time of about 2.5 seconds was measured, and the photosensitive material was then irradiated with light of 40 luxes (tungsten lamp) and the exposure quantity $E_{\frac{1}{2}}$ (lux·sec) necessary for discharging ½ of Vo was determined. The obtained results are shown in Table 1.

TABLE 1

| | Positive Charging | | | | Negative Charging | | | |
|---|---|---|---|---|---|---|---|---|
| | 2,3-dichloro-1,4-naphthoquinone | | | | | | | |
| | added (present invention) | | not added (comparison) | | added (present invention) | | not added (comparison) | |
| Sample | Vo (volts) | $E_{\frac{1}{2}}$ (lux · sec) | Vo (volts) | $E_{\frac{1}{2}}$ (lux · sec) | Vo (volts) | $E_{\frac{1}{2}}$ (lux · sec) | Vo (volts) | $E_{\frac{1}{2}}$ (lux · sec) |
| A | 425 | 18 | 555 | 43 | 370 | 44 | 450 | 75 |
| B | 410 | 34 | 528 | 52 | 365 | 46 | 432 | 52 |
| C | 300 | 38 | 428 | 80 | 350 | 46 | 436 | 76 |

From the results shown in Table 1, it is seen that the photosensitive material comprising 2,3-dichloro-1,4-naphthoquinone according to the present invention gave a higher sensitizing effect at either positive charging or negative charging, and that the sensitizing effect at positive charging was higher than the sensitizing effect at negative charging. It also was found that when N,N'-di(3,5-dimethylphenyl)perylene-3,4,9,10-tetracarboxylic acid diimide was used as the perylene pigment, a highest sensitivity was obtained.

EXAMPLE 2

Sensitizing effects obtained when a halonaphthoquinone (present invention) or unsubstituted naphthoquinone (comparison 1) was added to the system of PVK and N,N'-di(3,5-dimethylphenyl)perylene-3,4,9,10-tetracarboxylic acid diimide as the perylene pigment or when any naphthoquinone was not added (comparison 2) were examined. As the unsubstituted naphthoquinone, there was used 1,4-naphthoquinone, and as the halonaphthoquinone, there were used 2-chloro-1,4-naphthoquinone [sample (a)], 2,3-dichloro-1,4-naphthoquinone [sample (b)], 2,3-dibromo-1,4-naphthoquinone [sample (c)] and 2,3-dichloro-2,3-dihydro-1,4-naphthoquinone [sample (d)]. Photosensitive plates were prepared according to the following procedures.

At first, 0.2 g of N,N'-di(3,5-dimethylphenyl)perylene-3,4,9,10-tetracarboxylic acid diimide as the perylene pigment was dispersed in 6 g of tetrahydrofuran as the solvent and 0.5 g of cyclohexanone, and 10 g of PVK (tetrahydrofuran solution having a solid content of 10%), 2.0 g of a thermoplastic polyester resin having a molecular weight of 15000 to 20000 (Vylon 200 supplied by Toyobo Co.) (tetrahydrofuran solution having a solid content of 10%) as the reinforcing resin and 5 mg of a silicone oil as the levelling agent were added to the dispersion. Furthermore 0.2 g of the unsubstituted naphthoquinone (comparison 1) or halonaphthoquinone compound (present invention) was added to the dispersion to form a coating composition. For comparison, a coating composition (comparison 2) was prepared in the same manner as described above except that any naphthoquinone compound was not added. The so-formed coating composition was coated on a base obtained by forming an alumite layer having a thickness of about 5μ on an aluminum sheet having a thickness of 80μ, by a coating bar No. 40, and was dried at 100° C. for 20 minutes.

The obtained photosensitive materials were allowed to stand in the dark place overnight and the measurement was carried out in the same manner as described in Example 1. The obtained results are shown in Table 2.

TABLE 2

| | Positive Charging | | Negative Charging | |
|---|---|---|---|---|
| Sample No. | Vo (volts) | $E_{\frac{1}{2}}$ (lux · sec) | Vo (volts) | $E_{\frac{1}{2}}$ (lux · sec) |
| (a) (present invention) | 500 | 24 | 595 | 46 |
| (b) (present invention) | 450 | 18 | 485 | 33 |
| (c) (present invention) | 430 | 20 | 480 | 34 |
| (d) (present invention) | 515 | 23 | 620 | 48 |
| unsubstituted naphthoquinone (comparison 1) | 630 | 40 | 680 | 66 |
| not added (comparison 2) | 555 | 43 | 760 | 75 |

From the results shown in Table 2, it is apparent that when the halonaphthoquinone of the present invention was added, a high sensitizing effect could be obtained. It was found that 2,3-dichloro-1,4-naphthoquinone [sample (b)] was most preferred as the halonaphthoquinone and gave a highest sensitivity at either positive charging or negative charging.

EXAMPLE 3

A mixture comprising 10 g of PVK (tetrahydrofuran solution having a solid content of 10%), 5 g of tetrahydrofuran as the solvent, 0.1 g of N,N'-di(3,5-dimethylphenyl)perylene-3,4,9,10-tetracarboxylic acid diimide, 2 g of a thermoplastic polyester resin having a molecular weight of 18000 to 20000 (Vylon 103 supplied by Toyobo Co.) (tetrahydrofuran solution having a solid content of 10%), 0.2 g of 2,3-dichloro-1,4-naphthoquinone as the halonaphthoquinone, 1 g of a metal-free phthalocyanine (Heliogen Blue 7800 supplied by BASF) (dispersion of 1 part by weight of the phthalocyanine in 99 parts of toluene) and 5 mg of a silicone oil as levelling agent was sufficiently dispersed, and the composition was coated on a base obtained by forming an alumite layer having a thickness of about 10μ on an aluminum sheet having a thickness of 80μ, by using a coating bar No. 40 and was dried at 100° C. for 20 minutes. The so-obtained photosensitive plate was allowed to stand in the dark place overnight and was tested in the same manner as described in Example 1. The surface potential Vo was 400 volts and the half decay exposure quantity $E_{\frac{1}{2}}$ was 14 lux-sec. When this photosensitive plate was subjected to the copying test at a copying speed of 15 sheets per minute in a copying machine of the positive charging type. A good image was obtained and the 15th copy was excellent in the image characteristics.

What is claimed is:

1. A photosensitive plate for electrophotography, consisting essentially of an electrically conductive support and a photosensitive layer thereon, said photosensitive layer comprising 100 parts by weight of polyvinylcarbazole, 10 to 30 parts by weight of a perylene pigment represented by the following general formula

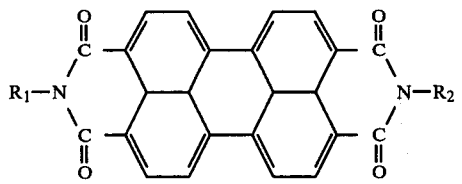

(2)

wherein $R_1$ and $R_2$ is a hydrogen atom or a substituted or unsubstituted alkyl or aryl group, and 10 to 30 parts by weight of 2,3-dichloro-1,4-naphthoquinone.

2. A photosensitive plate as set forth in claim 1 wherein the perylene pigment is N,N'-di(3,5-dimethylphenyl)perylene-3,4,9,10-tetracarboxylic acid diimide.

3. A photosensitive plate as set forth in claim 1 wherein said photosensitive layer further comprises a phthalocyanine pigment or disazo pigment in an amount of 2 to 10 parts by weight per 100 parts by weight of the perylene pigment.

4. A photosensitive plate as set forth in claim 1 wherein said photosensitive layer further comprises a resin binder having no photoconductivity in an amount of 0.1 to 50 parts by weight per 100 parts by weight of polyvinyl carbazole.

5. A photosensitive plate as set forth in claim 1 wherein said photosensitive layer further comprises a leveling agent in an amount of 0.005 to 5 parts by weight per 100 parts by weight of polyvinyl carbazole.

6. A photosensitive plate as set forth in claim 1 wherein said photosensitive layer has a thickness of from 3 to 30 microns.

7. A photosensitive plate as set forth in claim 1 wherein said photosensitive layer has a thickness of from 8 to 15 microns.

* * * * *